US006087820A

United States Patent [19]

Houghton et al.

[11] Patent Number: 6,087,820

[45] Date of Patent: Jul. 11, 2000

[54] CURRENT SOURCE

[75] Inventors: Russell J. Houghton; Ernst J. Stahl, both of Essex Junction, Vt.

[73] Assignees: Siemens Aktiengesellschaft, Munich, Germany; International Business Machines Corporation, Armonk, N.Y.

[21] Appl. No.: 09/265,252

[22] Filed: Mar. 9, 1999

[51] Int. Cl.[7] ..... G05F 3/16; G05F 3/20

[52] U.S. Cl. ..... 323/315; 323/907; 327/541

[58] Field of Search ..... 323/315, 312, 323/313, 314, 907; 327/538, 539, 541, 543

[56] References Cited

U.S. PATENT DOCUMENTS

| | | | |
|---|---|---|---|
| 4,243,948 | 1/1981 | Schade, Jr. | 330/289 |
| 4,587,478 | 5/1986 | Kasperkovitz et al. | 323/316 |
| 4,851,954 | 7/1989 | Surig | 323/271 |
| 4,935,690 | 6/1990 | Yan | 323/314 |
| 5,231,315 | 7/1993 | Thelen, Jr. | 307/491 |
| 5,572,161 | 11/1996 | Myers | 327/538 |
| 5,581,174 | 12/1996 | Fronen | 323/316 |
| 5,604,427 | 2/1997 | Kimura | 323/313 |
| 5,774,013 | 6/1998 | Groe | 327/543 |
| 5,818,294 | 10/1998 | Ashmore, Jr. | 323/315 |
| 5,889,394 | 3/1999 | Czarnocki | 323/313 |
| 5,939,872 | 8/1999 | Dubos et al. | 323/267 |

OTHER PUBLICATIONS

Gray et al., "Analysis and Design of Analog Integrated Circuits", pp. 338–347, Third Edition, Copyright © 1977, 1984, 1993 by John Wiley & Sons, Inc. No Month.

Bang–Sup Song et al., "A Precision Curvature–Compensated CMOS Bandgap Reference", IEEE Journal of Solid–State Circuits, vol. SC–18, No. 6, Dec./1983.

*Primary Examiner*—Shawn Riley
*Assistant Examiner*—Bao Q. Vu
*Attorney, Agent, or Firm*—Stanton C. Braden

[57] ABSTRACT

A method and circuit for producing an output current is provided. The method and circuit adds two currents with opposing temperature coefficients to produce such output current. A first one of the two currents, $I_1$, is a scaled copy of current produced in a temperature compensated bandgap reference circuit. A second one of the two currents, $I_2$, is derived from a temperature stable voltage produced by the bandgap circuit divided by a positive temperature coefficient resistance. The added currents, $I_1+I_2$, provide the output current. The circuit includes a first circuit for producing: (i) a reference current having a positive temperature coefficient; and (ii) an output voltage at an output node substantially insensitive to variations in supply voltage and temperature over a predetermined range. The current source includes a second circuit connected to the output node for producing a first current derived from the bandgap reference current. The first current has a positive temperature coefficient. Also provided is a third circuit connected to the output node for producing a second current derived from the output voltage, such second current having a negative temperature coefficient. The first and second currents are summed at the output node to produce, at the output node, an output current related to the sum of the first and second currents, such output current being substantially insensitive to variations in temperature and supply voltage over the predetermined range.

17 Claims, 3 Drawing Sheets

CURRENT SOURCE

BACKGROUND OF THE INVENTION

This invention relates generally to current sources and more particularly to current sources adapted to produce current insensitive to temperature and external voltage supply variations.

As is known in the art, many applications require the use of a current source. Various types of current sources are described in Chapter 4 of *Analysis and Design of Analog Integrated Circuits* (Third Edition) by Paul R. Gray and Robert G. Meyer, 1993, published by John Wiley & Sons, Inc. New York, N.Y. As described therein, these current sources are used both as biasing elements and as load devices for amplifier stages. As is also known in the art, it is frequently desirable to provide a current source which is adapted to produce current insensitive to temperature and external voltage supply variations.

SUMMARY OF THE INVENTION

In accordance with the present invention, a method is provided for producing an output current. The method includes adding two currents with opposing temperature coefficients to produce such output current. A first one of the two currents, $I_1$, is a scaled copy of current produced in a temperature compensated bandgap reference circuit. A second one of the two currents, $I_2$, is derived from a temperature stable voltage produced by the bandgap circuit divided by a positive temperature coefficient resistance. The added currents, $I_1+I_2$, provide the output current.

In accordance with another feature of the invention, a current source is provided. The current source includes a first circuit for producing: (i) a reference current having a positive temperature coefficient; and (ii) an output voltage at an output node substantially insensitive to variations in supply voltage and temperature over a predetermined range. The current source includes a second circuit connected to the output node for producing a first current derived from the reference current. The first current has a positive temperature coefficient. Also provided is a third circuit connected to the output node for producing a second current derived from the output voltage, such second current having a negative current temperature coefficient. The first and second currents are summed at the output node to produce, at the output node, an output current related to the sum of the first and second currents, such output current being substantially insensitive to variations in temperature and supply voltage over the predetermined range.

In accordance with another embodiment, the second circuit comprises a current mirror.

In accordance with another embodiment, the third circuit comprises a resistor.

In accordance with one embodiment, the first circuit comprises a bandgap reference circuit.

In accordance with one embodiment, the bandgap reference circuit is a self-biased bandgap reference circuit.

In accordance with one embodiment, the self-biased bandgap reference circuit comprises CMOS transistors.

In accordance with the invention, a current source is provided having a bandgap reference circuit adapted for coupling to a supply voltage. The bandgap reference circuit produces: a bandgap reference current having a positive temperature coefficient; and, at an output current summing node, an output voltage substantially insensitive to variations in supply voltage and temperature over a predetermined range. A current summing circuit is provided having a pair of current paths, one of such paths producing a first current derived from the bandgap reference current. The first current has a positive temperature coefficient. Another one of such pair of current paths produces a second current derived from the output voltage. The second current has a negative current temperature coefficient. The first and second currents are summed at the summing node to produce, at the summing node, a current substantially insensitive to variations in temperature and supply voltage over the predetermined range.

In accordance with one embodiment, a current source is provided having a bandgap reference circuit for producing a temperature dependent current which increases with temperature and a temperature stable voltage. A differential amplifier is provided having one of a pair of inputs fed by the temperature stable voltage. A MOSFET has a gate connected to the output of the amplifier and one of the source/drain electrodes is connected to one of the inputs of the amplifier in a negative feedback arrangement. The other one of the source/drain electrodes is coupled to a voltage supply. A summing node is provided at the output of the amplifier. A resistor is connected to the summing node for passing a first current at the summing node. A current mirror is fed by the temperature variant current, for passing a second current at the node. The MOSFET passes through the source and drain electrodes thereof a third current related to the sum of the first and second currents, such third current being independent of temperature.

BRIEF DESCRIPTION OF THE DRAWING

Other features of the invention, as well as the invention itself, will become more readily apparent from the following detailed description when read together with the accompanying, in which.

DESCRIPTION OF THE PREFERRED EMBODIMENTS

Figure 1:
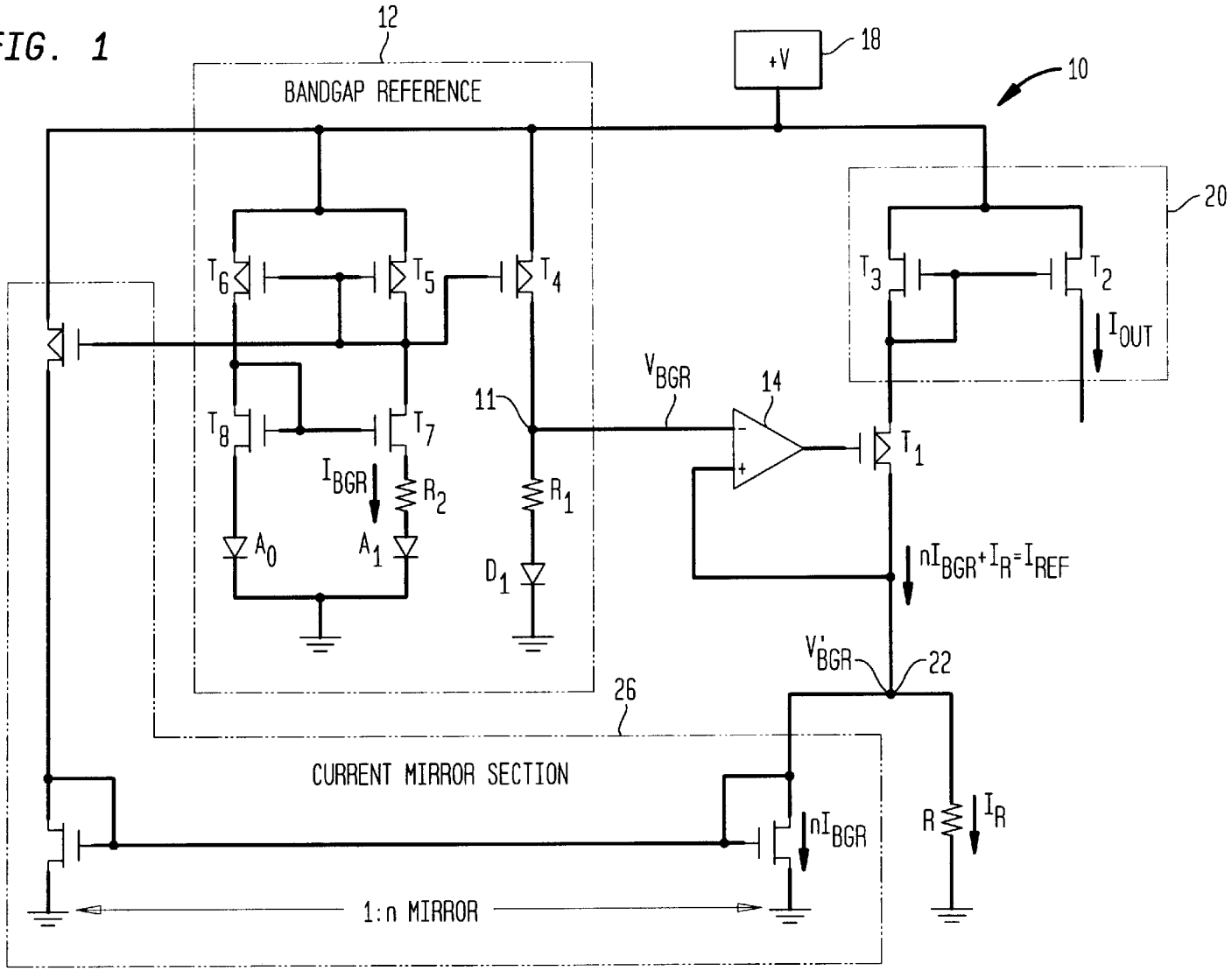
FIG. 1 is a schematic diagram of a current source in accordance with the invention.

Referring now to FIG. 1, a temperature, voltage supply insensitive current source 10 is shown. The current source 10 includes a bandgap reference circuit 12 for producing a temperature dependent current IBGR which increases with increasing temperature, T, and, in response to such temperature dependant current $I_{BGR}$, a temperature stable voltage $V_{BGR}$ at output 11 of the circuit 12. The current source 10 also includes a differential amplifier 14 having one input, here the inverting input (−) fed by the temperature stable voltage $V_{BGR}$. A Metal Oxide Semiconductor Field Effect Transistor (MOSFET), here a p-channel MOSFET, $T_1$, has a gate electrode connected to the output of the amplifier 14. One of the source/drain electrodes of MOSFET $T_1$, here the drain electrode, is connected to the other one of the inputs, here the non-inverting (+) input of the amplifier 14 in a negative feedback arrangement. The other one of the source/drain electrodes of MOSFET $T_1$, here the source electrode, is coupled to a voltage supply 18 though a current mirror 20. A summing node 22 is connected to the drain of the MOSFET $T_1$. A resistor R having a resistance R(T) which increases with temperature, T, is connected to the summing node 22 for passing a first current $I_R$ at the summing node 22. More particularly, the resistor R is connected between the summing node 22 and a reference potential, here ground, as indicated.

Figure 2:
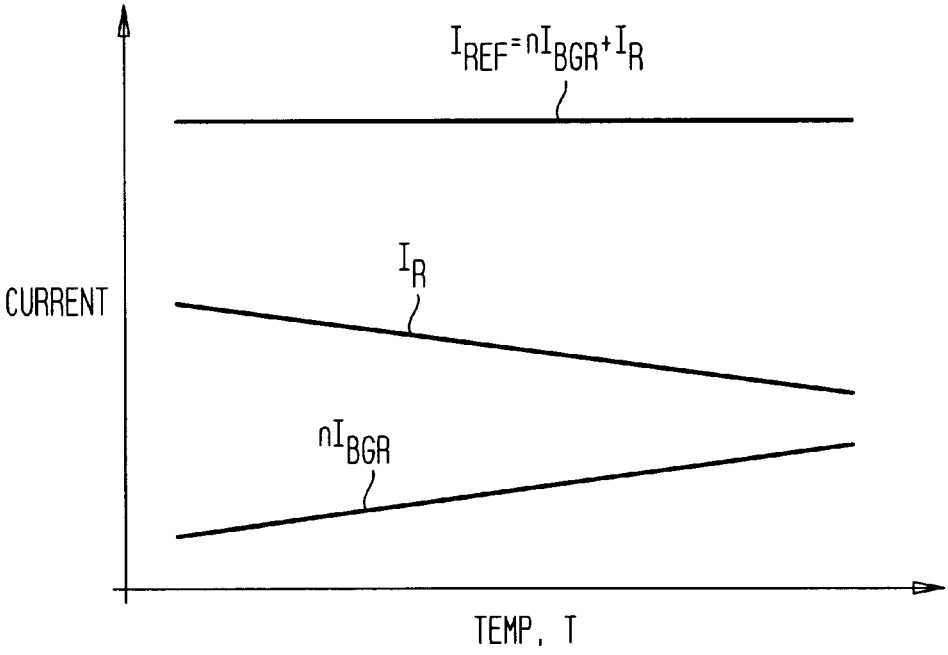
FIG. 2 is a sketch showing the relationship between currents produced in the circuit of FIG. 1 as a function of temperature, T.

A current mirror section 26, responsive to the temperature variant current $I_{BGR}$ produced in the bandgap reference circuit 12, passes a second current $nI_{BGR}$ at the summing node 22, where n is a scale factor selected in a manner to be described. Suffice it to say here, however, that, the voltage $V'_{BGR}$ at the summing node 22 is held by the feedback arrangement provided by amplifier 14 and MOSFET $T_1$ substantially invariant with temperature and power supply 18 variations. That is, the voltage $V'_{BGR}$ at the summing node 22 is driven to the reference voltage VBGR fed to the inverting input (−) of amplifier 14 (i.e., the bandgap reference voltage produced by the bandgap reference circuit 12). As will be described, and as mentioned above, the current $I_{BGR}$ increases with temperature, T. Thus, the current $nI_{BGR}$ also increases with temperature, T as indicated in FIG. 2. On the other hand, because the resistance R(T) of resistor R increases with temperature while the voltage $V'_{BGR}$ is substantially invariant with temperature, T, the current $I_R$ from summing node 22 to ground through resistor R deceases with temperature, T, as indicated in FIG. 2. The value of the resistance of resistor R and the value of n are selected so that the sum of the currents $nI_{BGR}$ and $I_R$ is substantially invariant with temperature, T, as indicated in FIG. 2.

To put it another way, the current source 10 operates to produce an output current, $I_{REF}=nI_{BGR}+I_R$ into the summing node 22 which is substantially invariant with variations in temperature, T, and power supply 18 variations. The circuit 10 produces such temperature/power supply invariant current $I_{REF}$ by adding two currents with opposing temperature coefficients to produce such output current, a first one of the two currents, $nI_{BGR}$, being a scaled copy of current $I_{BGR}$ produced in a temperature compensated bandgap reference circuit 12 and a second one of the two currents, $I_R$, being derived from a temperature stable voltage $V_{BGR}$ produced by the bandgap circuit 12 divided by a positive temperature coefficient resistance, i.e., the resistor R, such added currents, $nI_{BGR}+I_R$, being the output current $I_{REF}$.

The current mirror 20 (FIG. 1) is used to produce a current $I_{OUT}=[M/N]I_{REF}$, where M/N is a scale factor provided by the p-channel transistors $T_2$ and $T_3$ used in the current mirror 20.

More particularly, the bandgap reference circuit 10 includes p-channel MOSFETs $T_4$, $T_5$ and $T_6$, n-channel MOSFETs $T_7$ and $T_8$, and diodes $A_0$ and $A_1$ all arranged as shown. The bandgap reference circuit 12 is connected to the +Volt supply 18 having a voltage greater than the sum of the forward voltage drop across diode $D_1$, the threshold voltage of transistor $T_5$, and the threshold voltage of transistor $T_8$. The bandgap reference circuit 12 also includes a resistor $R_1$ and a diode $D_1$ arranged as shown. The diodes $D_1$, $A_0$, and $A_1$ are thermally matched. In the steady-state, the current through the diode $A_1$ (i.e., the bandgap reference current $I_{BGR}$) will increase as a function of $V_T=kT/q$, where k is Boltzmann's constant, T is temperature, and q is the charge of an electron. For silicon, k/q is approximately 0.086 mV/° C. This current $I_{GBR}$ is mirrored by the arrangement of transistors $T_5$, $T_6$, $T_7$ and $T_8$, such that the current $I_{BGR}$ passes though diode $A_1$ and the diode $D_1$. The voltage at the output 11 (i.e., the voltage $V_{BGR}$) of the bandgap reference circuit 12 will however be substantially constant with temperature T because, while the current through resistor $R_1$, which mirrors the current $I_{BGR}$, will also increases with temperature, the voltage across the diode $D_1$ will decrease with temperature in accordance with −2 mV/° C. Thus, the output voltage at 11 (i.e., VBGR) may be expressed as:

$$V_{EGR}=V_{BE}+\alpha V_T$$

where α is a constant.

It will now be demonstrated algebraically how to select the value for R that makes the sum current $I_{REF}$ independent i.e., insensitive, to temperature. It is ideally assumed that to a first order resistors $R_2$ and R have a linear dependance with temperature over the temperature range of interest, i.e., over the nominal temperature range the circuit 10 is expected to operate. Thus:

$$R_2=R_{2T0}(aT+b);\ \text{and}\ R=R_{T0}(aT+b)$$

where:

$R_{2T0}$ and $R_{T0}$ are the resistance values at a reference temperature T0;

a is the resistance temperature coefficient of resistors $R_2$ and R; and b is a constant.

The current $I_{BGR}$ produced within the bandgap reference circuit 10 (also, current through resistor $R_1$) is well known and may be expressed as:

$$I_{BGR}=\frac{1}{R_2(T)}\frac{kT}{q}\ln\left(\frac{A_1}{A_0}\right)$$

where:

$A_1/A_0$ is the diode area ratio (typically 10) and kT/q is the thermal voltage (i.e., k is Boltzmann's constant, T is temperature, and q is the charge of an electron).

Current through the resistor R is:

$$I_R=\frac{V_{BGR}}{R(T)}$$

$V_{BGR}$ is made independent of temperature by design choice. The sum current $I_{REF}$ is the result of multiplying $I_{BGR}$ by a gain factor n provided by current mirror section 26 and adding it to the current passing through R. This is expressed in algebraic form:

$$\frac{n}{R_{2T0}(aT+b)}\frac{kT}{q}\ln\left(\frac{A_1}{A_0}\right)+\frac{V_{BGR}}{R_{T0}(aT+b)}=I_{REF}=\text{CONSTANT}$$

Multiplying this expression by (aT+b) and rearranging terms yields:

$$\frac{nk}{R_{2T0}q}\ln\left(\frac{A_1}{A_0}\right)T+\frac{V_{BGR}}{R_{T0}}=aI_{REF}T+b_{I_{REF}}$$

To achieve temperature independence, the coefficient constants of T must be equal. Therefore, $$\frac{nk}{R_{2T0}q}\ln\left(\frac{A_1}{A_0}\right)=a_{I_{REF}}$$

and for the equality to be true:

$$\frac{V_{BGR}}{R_{T0}} = b_{I_{REF}}$$

The last two equations are combined by eliminating $I_{REF}$ and solving for $R_{T0}$ which yields:

$$R_{T0} = \frac{\frac{a}{b}V_{BGR}}{\frac{nk}{q}\ln\frac{(A_1)}{(A_0)}}R_{2T0}$$

All values in this last equation for $R_{T0}$ are known. The resistance temperature characteristic is defined by the constants a and b. The bandgap reference circuit design defines $A_0$, $A_1$, $R_{2T0}$ and $V_{BGR}$. The factor n is the designer's choice. A value of n=1 would be typical. The constants k and q are known physics constants, as described above.

It is important to note from the above analysis that the temperature compensation is not a function of the value of resistor R. Only the absolute value of the current IBGR depends on the value of resistor R. The resistor ratio $R_2/R$ should constant with process variations when the circuit is formed on the same semiconductor chip. This is a significant advantage of the invention.

DESIGN EXAMPLE

DIODE AREA RATIO, $A_1/A_0$=10;

$R_2$=71 kilohms or 0.071 megohms at a T0 of 83 degrees Centigrade;

k/q=86.17×$10^{-6}$ V/degree Kelvin;

$V_{BGR}$=1.2 volts;

T0=83 degrees Centigrade=356 degrees Kelvin (K)= Reference Temperature;

a=0.0013 1/K;

b=0.537;

n=1

R=1040 kilohms or 1.04 MegOhms at 83 degrees Centigrade.

Using this value for R and substituting into the expression above for $I_{REF}$ gives the equation for the temperature dependence of $I_{REF}$ below:

$$\frac{86.17\times10^{-6}\times\ln(10)}{0.071\times(0.0013T+0.537)}T+\frac{1.2}{1.04\times(0.0013T+0.537)} = I_{REF}(micoramps)$$

Figure 3:
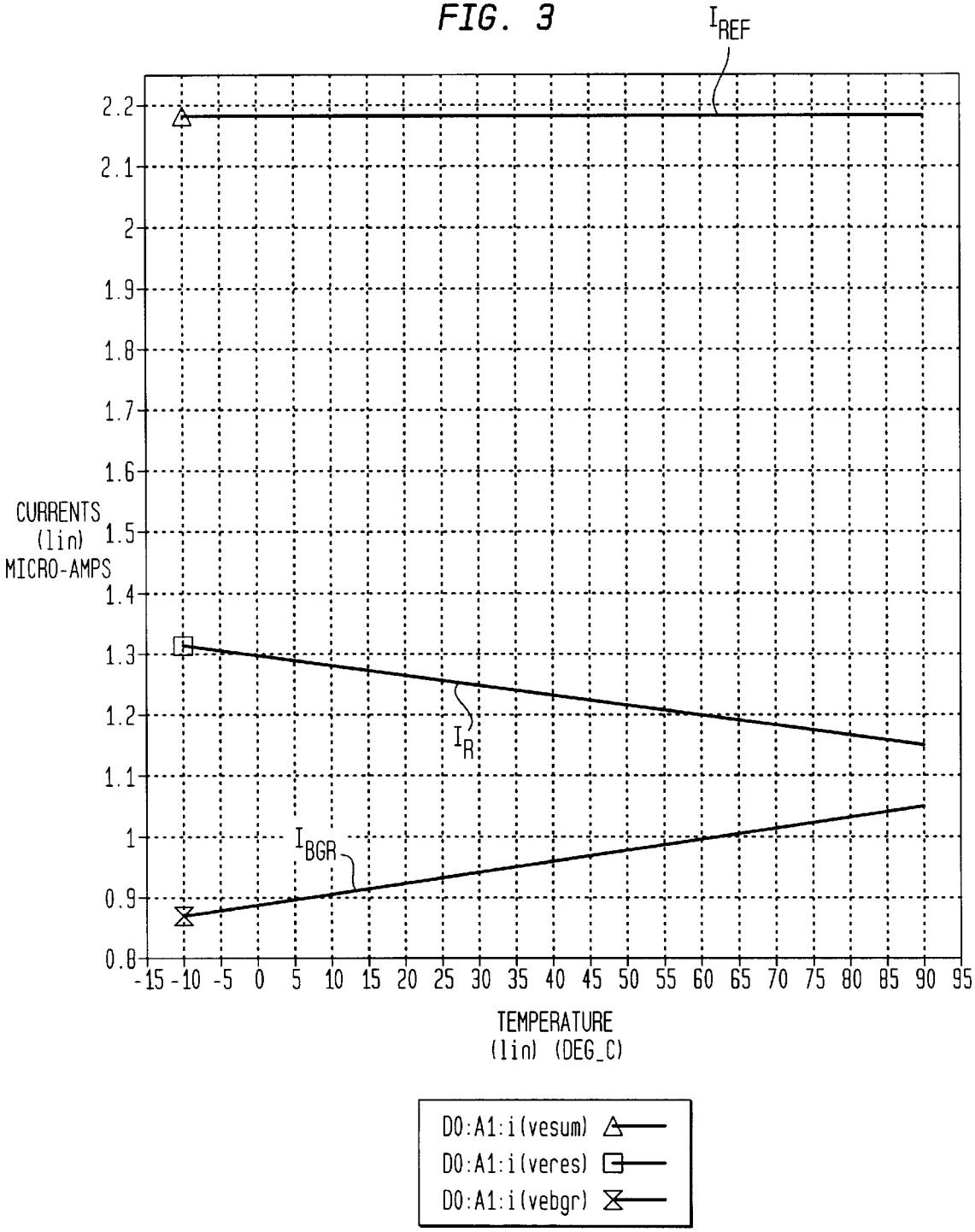
FIG. 3 is plot showing SPICE simulation results of the circuit of FIG. 1.

A SPICE simulation using the same values from this design example confirms the calculations. The output of this simulation is shown in FIG. 3. The results show the opposing temperature slopes of the two currents $I_{BGR}$ and $I_R$ and their temperature independent sum $I_{REF}$ over the range of temperatures from −10 degrees Centigrade to +90 degrees Centigrade.

Other embodiments are within the spirit and scope of the appended claims.

What is claimed is:

1. A method for generating a temperature independent current comprising adding a current produced by a temperature compensated bandgap reference to a current passing through a temperature dependant resistor.

2. A method for producing an output current, comprising: adding two currents with opposing temperature coefficients to produce such output current, a first one of the two currents, $I_1$, being a scaled copy of current produced in a temperature compensated bandgap reference circuit and a second one of the two currents, $I_2$, being derived from a temperature stable voltage produced by the bandgap circuit divided by a positive temperature coefficient resistance, such added currents, $I_1+I_2$, being the output current.

3. A current source, comprising:

(a) a first circuit for producing:

(i) a reference current having a positive temperature coefficient; and (ii) an output voltage at an output node substantially insensitive to variations in supply voltage and temperature over a predetermined range;

(b) a second circuit for producing a first current derived from the reference current, such first current having a positive temperature coefficient;

(c) a third circuit connected to the output node for producing a second current derived from the output voltage, such second current having a negative current temperature coefficient; and (d) wherein the first and second currents are summed at the output node to produce, at the output node, an output current related to the sum of the first and second currents, such output current being substantially insensitive to variations in temperature over the predetermined range.

4. The current source recited in claim 3 wherein the second circuit comprises a current mirror.

5. The current source recited in claim 3 wherein the third circuit comprises a resistor.

6. The current source recited in claim 5 wherein the second circuit comprises a current mirror.

7. The current source recited in claim 3 wherein the first circuit comprises a bandgap reference circuit.

8. The current source recited in claim 7 wherein the bandgap reference is a self-biased bandgap reference circuit.

9. The current source recited in claim 8 wherein the self-biased bandgap reference circuit comprises CMOS transistors.

10. The current source recited in claim 8 wherein the second circuit comprises a current mirror.

11. The current source recited in claim 9 wherein the third circuit comprises a resistor.

12. The current source recited in claim 11 wherein the second circuit comprises a current mirror.

13. A current source, comprising:

a bandgap reference circuit adapted for coupling to a supply voltage, such circuit producing a bandgap reference current having a positive temperature coefficient and producing, at an output current summing node, an output voltage substantially insensitive to variations in supply voltage and temperature over a predetermined range;

a current summing circuit comprising: a pair of current paths, one of such paths producing a first current derived from the bandgap reference current, such first current having a positive temperature coefficient and another one of such pair of current paths producing a second current derived from the output voltage, such second current having a negative temperature coefficient; and wherein the first and second currents are summed at the summing node to produce, at the summing node, a current substantially insensitive to variations in temperature and supply voltage over the predetermined range.

14. The current source recited in claim 13 wherein the current summing circuit comprises a current mirror responsive to the bandgap reference current for producing the first current.

15. The current source recited in claim 14 wherein the current summing circuit comprises a resistor connected to the summing node.

16. A current source, comprising:

a bandgap reference circuit for producing a temperature dependent current which increases with increasing temperature and a temperature stable voltage;

a differential amplifier having one of a pair of inputs fed by the temperature stable voltage;

a transistor having a gate connected to the output of the amplifier and a first one of the source/drain electrodes connected to one of the inputs of the amplifier in a negative feedback arrangement, a second one of the source/drain electrodes being coupled to a voltage supply;

a summing node connected to the the first one of the source/drain electrodes;

a resistor connected to the summing node for passing a first current at the summing node;

a current mirror fed by the current produced by the bandgap reference circuit, for passing a second current at the node;

such transistor passing through the source and drain electrodes thereof a third current related to the sum of the first and second currents.

17. A current source, comprising:

a bandgap reference circuit for producing a bandgap reference voltage substantially constant with temperature and a current having a positive temperature coefficient, such bandgap reference circuit comprising a series circuit comprising a diode and a first resistor, such current passing through the series circuit;

a differential amplifier having one of a pair of inputs fed by the bandgap reference voltage;

a transistor having a gate connected to the output of the amplifier and a first one of the source/drain electrodes connected to the other one of the pair of the inputs of the amplifier in a negative feedback arrangement, a second one of the source/drain electrodes being coupled to a voltage supply;

a summing node connected to the first one of the source/drain electrodes;

a second resistor connected to the summing node for passing a first current at the summing node;

a current mirror fed by the current produced by the bandgap reference circuit, for passing a second current at the node;

such transistor passing through the source and drain electrodes thereof a third current related to the sum of the first and second currents.

* * * * *